United States Patent [19]

Frind

[11] 4,224,490

[45] Sep. 23, 1980

[54] FLUID BLAST CIRCUIT BREAKER

[75] Inventor: Gerhard Frind, Altamont, N.Y.

[73] Assignee: General Electric Company, Schenectady, N.Y.

[21] Appl. No.: 958,041

[22] Filed: Nov. 6, 1978

[51] Int. Cl.[2] ..... H01H 33/70

[52] U.S. Cl. ..... 200/148 R; 200/148 A; 200/148 G

[58] Field of Search ..... 200/144 R, 148 R, 148 A, 200/148 B, 148 C, 148 D, 148 E, 148 F, 148 G, 148 H, 148 J, 148 BV, 150 G

[56] References Cited

U.S. PATENT DOCUMENTS

| | | | |
|---|---|---|---|
| 2,133,938 | 10/1938 | Ruppel | 200/148 R |
| 2,798,922 | 7/1957 | Lingal et al. | 200/148 G |
| 3,679,851 | 7/1972 | Latour et al. | 200/148 A |

*Primary Examiner*—J. V. Truhe
*Assistant Examiner*—Morris Ginsburg
*Attorney, Agent, or Firm*—Nathan D. Herkamp; James C. Davis, Jr.; Paul R. Webb, II

[57] ABSTRACT

The contacts and nozzle of a fluid blast circuit breaker are constructed to have a cross section with a shape other than circular or square. Such cross section facilitates providing the fluid for extinguishing an arc in a circuit breaker at a velocity perpendicular to the arc greater than the fluid velocity in a circular or square configuration nozzle having the same cross sectional area. Such high velocity fluid flow facilitates interrupting the arc by increasing the cooling rate of fluid flow past the arc.

20 Claims, 8 Drawing Figures

FLUID BLAST CIRCUIT BREAKER

BACKGROUND OF THE INVENTION

This invention relates to fluid blast circuit breakers including the puffer type and the two-pressure storage type. More particularly, this invention relates to a novel contact and nozzle configuration which enhances arc cooling by the fluid blast to facilitate extinguishing the arc created by opening the contacts.

When contacts are opened in a fluid blast circuit breaker, an arc is created between the contacts. The arc is formed of a plasma of ionized gas which carries the arcing current. When the heated plasma is cooled, its electrical resistivity increases markedly until the plasma is no longer able to carry the arcing current. In an alternating current system, the energy content of the arc at zero crossing of the current is low. If an adequate supply of cooling fluid is applied to the arc near the instant of zero crossing, the plasma is cooled adequately to interrupt the arc and thereby break the circuit. It is known in the circuit breaker art that the flow component of the extinguishing fluid in the direction perpendicular to the arc restricts the diameter of the arc, which facilitates cooling of the arc improving the probability of interrupting the arc.

The decisive physical characteristic which controls the restriction of the cross sectional dimensions of the arc is the velocity of the fluid flow perpendicular to the arc. The prior art techniques have attempted to improve arc-extinguishing fluid flow by bringing nozzles or nozzle structures into the arc path. All of the known prior art structures used to increase the radial velocity of the fluid flow have been of circular cross section. For example, in U.S. Pat. No. 3,551,624 issued Dec. 29, 1970 to Fischer, additional structure is introduced into the arc path to eliminate high back pressure exerted by the arc on the fluid flow, and, in U.S. Pat. No. 3,946,180, issued Mar. 23, 1976 to Votta et al., additional parts are provided in the nozzle to facilitate fluid flow into the arcing region. The limitation on the diameter of the nozzle is that its diameter must be adequate to avoid choking, i.e., blocking the flow of fluid over the arc by providing inadequate space between the nozzle and the contact structure. A similar choking problem exists in attempting to increase fluid flow velocity in structures having square nozzles.

Therefore, the primary object of the instant invention is to provide a nozzle structure which allows increased radial velocity of the arc extinguishing fluid without choking the fluid flow.

BRIEF DESCRIPTION OF THE INVENTION

Briefly, in accordance with a preferred embodiment of the invention, an electrical circuit breaker containing relatively movable contacts within an arcing chamber and nozzle means located to surround space between the contacts when they are separated is described. The nozzle means is shaped to have a throat cross section other than circular or square, producing a flow of arc-extinguishing fluid having radial components of velocity higher than those exhibited by a circular or square nozzle, and thereby, more effectively narrowing the arc to cool the plasma than would flow from round or square nozzles having approximately the same cross sectional area. In a preferred embodiment of the invention, the nozzle throat and the contacts are of rectangular cross section, and the cooling fluid is an insulating gas or gas mixture. In another preferred embodiment the nozzle throat and contacts are of elliptical cross section.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

MANNER AND PROCESS OF MAKING AND USING THE INVENTION

The particular apparatus shown in FIGS. 1–8 and the technique described in conjunction therewith are merely exemplary, and the scope of the invention is defined in the claims.

Figure 1:
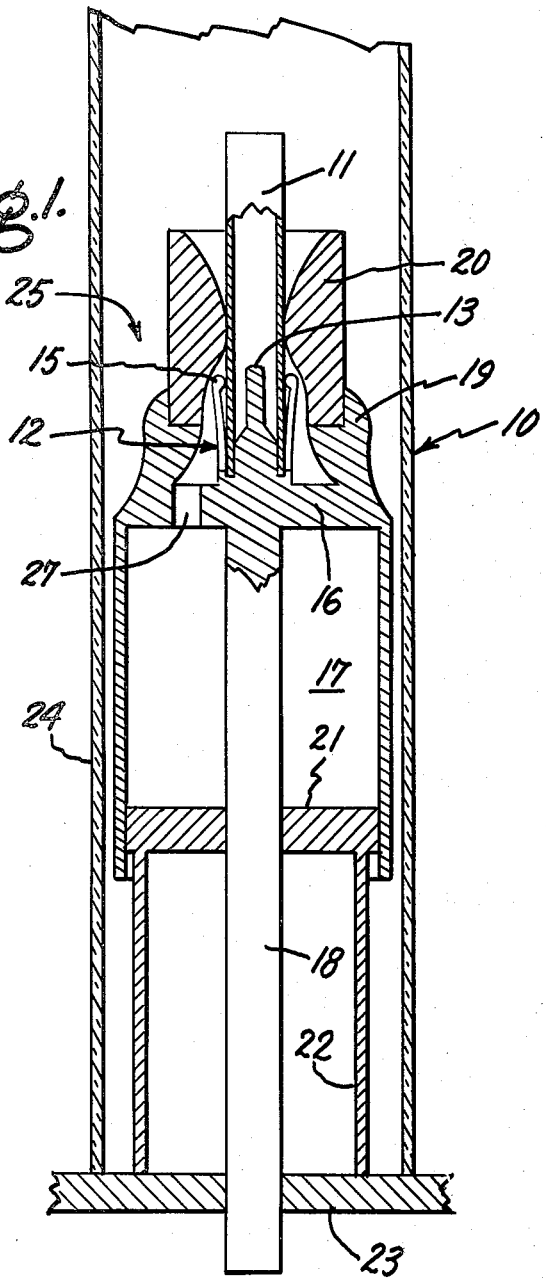
FIG. 1 is a schematic cross sectional view of a puffer type circuit breaker which may be employed with the instant invention.
Figure 2:
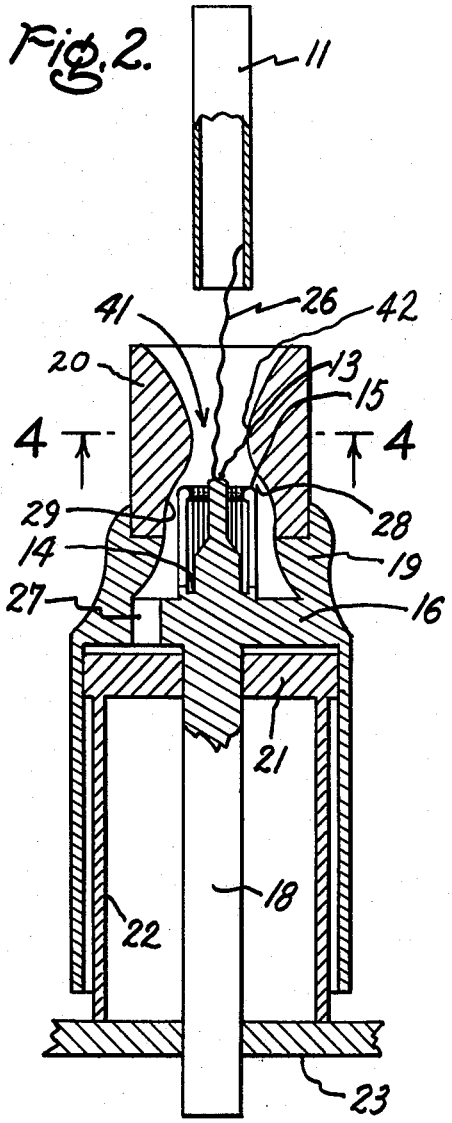
FIG. 2 is a schematic cross sectional view similar to FIG. 1 and showing the contacts in the separated position.

In FIGS. 1 and 2 is shown a fluid blast circuit breaker 10 of the puffer type. Upper contact 11 is shaped as a hollow rectangular rod. The lower contact 12 is shaped in a complementary shape having a center rod 13 surrounded by a groove 14 into which the upper contact 11 fits when the contacts are closed and a plurality of resilient contact fingers 15 surrounding groove 14 and making contact with the outer rectangular surface of upper contact 11 when closed. Lower contact 12 is mounted on end wall 16 of a chamber 17 for containing the insulating and arc-extinguishing fluid when the contacts are closed. Attached to end wall 16 is a rod 18 for moving contact 12 and end wall 16 for opening or closing the contacts. Extending from end wall 16 adjacent and surrounding contact 12 is a shoulder member 19 upon which is mounted a nozzle means 20 having a convergent-divergent passage 41 therethrough. At the end of chamber 17 opposite movable end wall 16 is a fixed end wall 21 mounted rigidly to a rigid support member 22 secured to fixed support 23. The entire contact assembly is contained within a housing 24 which forms an enclosed switching chamber 25.

When the contacts are moved into their open position illustrated in FIG. 2, an arc 26 is formed between fixed contact 11 and movable contact 12 by the ionization of the medium between the contacts and by ionization of a small part of the material of the contacts themselves.

This plasma arc 26 must be broken to successfully interrupt the current flowing through the circuit breaker. As lower contact 12 is moved away from upper contact 11 breaking the circuit and forming the arc, movable end wall 16 is drawn toward fixed end wall 21 thereby reducing the volume within chamber 17 and forcing a pressurized flow of arc-extinguishing fluid through passage 27 over fingers 15 and into nozzle throat 42 in the vicinity of arc 26. The flow of arc-extinguishing fluid tends to constrict the arc, so that when current zero occurs, the energy content of the arc is inadequate to maintain the plasma state of the medium between the opened contacts.

Figure 3:
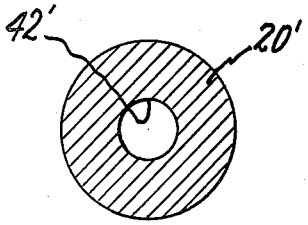
FIG. 3 is a cross sectional view of the throat of a conventional nozzle.

FIG. 3 shows a cross sectional view of a conventional circular nozzle 20' for a fluid blast circuit breaker having a circular throat 42'. In this configuration the radial velocity of the arc-extinguishing fluid traveling through the throat 42' is the same in all directions perpendicular to the axis of the nozzle 20'. It is known that the higher the velocity of the cooling fluid in a direction perpendicular to the arc, the more consolidated the arc becomes, and the greater the likelihood that the arc will be extinguished. The flow rate of coolant fluid can be accelerated by narrowing the width of throat 42' to restrict the flow cross section. However, the narrowing is limited by the fact that the flow is choked, if the gap between the contact fingers and the inner surface of the nozzle is narrowed to an area too small to allow fluid flow at the rate necessary to pass the required volume of fluid.

Figure 4:
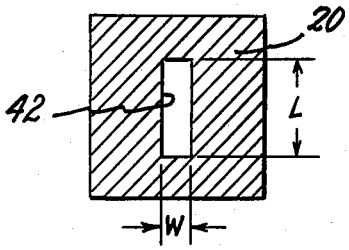
FIG. 4 is a schematic cross sectional view of a nozzle taken along line 4—4 of FIG. 2.
Figure 5:
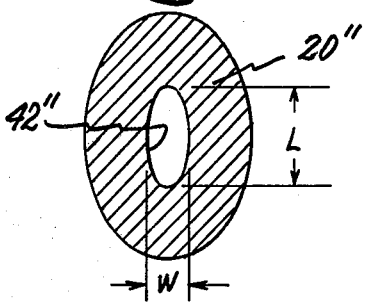
FIG. 5 is a schematic cross sectional view of a nozzle taken at the throat of the nozzle illustrating another preferred embodiment of the instant invention.

In FIGS. 4 and 5 are shown cross sectional views of nozzles shaped according to my invention. I have found that the radial component of the velocity of the fluid (which is responsible for producing arc contraction) is approximately inversely proportional to the diameter of the nozzle throat. I have discovered that by using a rectangular nozzle throat 42 and a rectangular convergent-divergent central passage 41 as shown in FIGS. 2 and 4 or an elliptical nozzle throat 41'' as shown in FIG. 5 and an elliptical convergent-divergent central passage (not shown), the throat can be narrowed in width to a smaller dimension without choking than is possible with a circular or square nozzle throat. Thereby, a higher radial component of velocity of arc-extinguishing fluid is achieved at the gap 28 between the flexible fingers 15 and the inside surface 29 of the nozzle throat 42. Therefore, arc-extinguishing performance can be enhanced by utilizing my novel nozzle structure.

By forcing a flow of high velocity arc-extinguishing fluid over the arc in the shape of a rectangle or ellipse having a length, L, to width, W, ratio of between 1½:1 to 8:1, my device forces the arc 26 into the shape of a fine filament of hot plasma having a low energy content during the time the alternating current in the arc is near zero. This fine filament can be rapidly cooled by the extinguishing fluid and the arc thereby broken. The preferred arc-extinguishing fluids are sulfur hexafluoride ($SF_6$) gas and mixtures of $SF_6$ with other insulating fluids such as fluorocarbon gases such as described in U.S. patent application Ser. No. 900,726 of Hudis assigned to the instant assignee.

Figure 6:
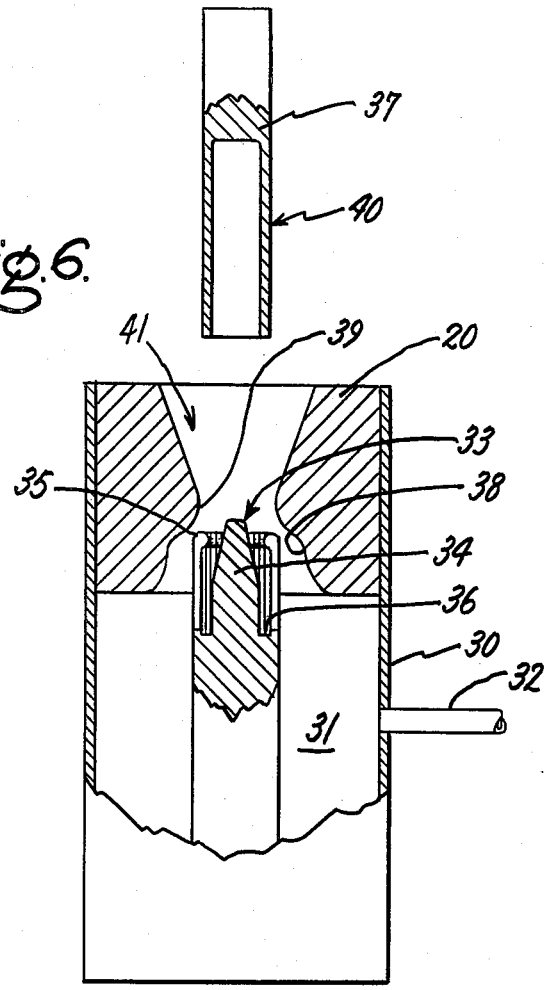
FIG. 6 is a schematic cross sectional view of a two-pressure type circuit breaker incorporating the nozzle of the instant invention.

In FIG. 6 is illustrated an alternate fluid blast circuit breaker which is of the two-pressure type. In such apparatus a tank 30 containing a volume 31 of arc-extinguishing fluid is provided. The fluid is pressurized to a high pressure by filling the tank 30 through the inlet tube 32 from a high pressure source (not shown), and closing the inlet with a valve or other means (not shown) to maintain the pressure. Fixed contact 33 is affixed to one end of the tank 30 containing insulating fluid. The fixed contact 33 comprises a center arcing contact 34 and a plurality of resilient contact fingers 35 surrounding a notch 36 for insertion therein of the movable electrode 37. Nozzle means 20 having convergent-divergent central passage 41 is inserted into the tank 30, so that the inner wall 38 of nozzle 20 is located in close proximity to the contact fingers 35. When the upper electrode 37 moves out of contact with the lower electrode 33 and out of throat 39 in nozzle 20, the pressurized arc-extinguishing fluid passes over the contact fingers 35 into the throat 39 of the nozzle 20 to cool and extinguish the arc as described above with respect to the first embodiment. The preferred dimension ratio of L to W is 1½:1 to 8:1 for the oblong nozzle throat for the two pressure system of FIGS. 6–8.

Figure 7:
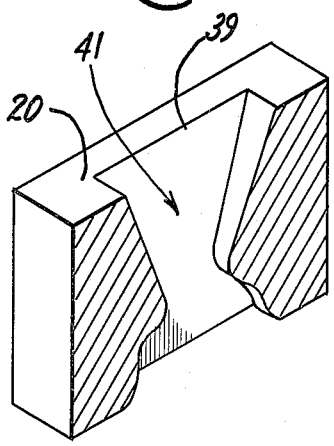
FIG. 7 is a schematic three-dimensional view shown in cross section of the nozzle of FIG. 6.
Figure 8:
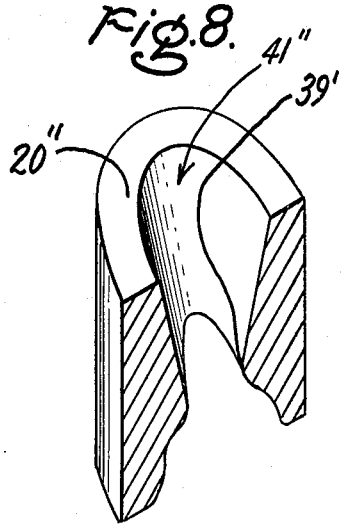
FIG. 8 is a schematic three-dimensional view shown in cross section of another preferred embodiment of the nozzle according to the instant invention.

FIGS. 7 and 8 are perspective cross sectional views of nozzles having rectangular and elliptical central passages 41 and 41'', respectively, used in the embodiment illustrated in FIG. 6. In order to provide the sealing of the gas container, the outer surface 40 of movable electrode 37 is shaped to conform closely to the shape of the throat 39 in the rectangular passage 41 of nozzle 20 of FIG. 7 or the elliptical passage 41'' of nozzle 20'' of FIG. 8. Thereby, the volume 31 of tank 30 is sealed even at high pressure until the contacts open. It will be understood by those skilled in the art that conventional valve and actuator means may be added to the tank 30 to control initiation of flow of arc-extinguishing fluid over the arc.

By using the above-described novel nozzle construction, I have been able to achieve a significant improvement in fluid blast circuit breaker arc-extinguishing performance. No additional attachments to the nozzle are required in my invention. The resultant device is a simple, effective means to enhance arc-extinguishing performance of fluid blast circuit breakers.

BEST MODE

The best mode of carrying out applicant's invention incorporates the puffer breaker configuration 10 illustrated in FIGS. 1 and 2 having a nozzle with a central passage having an elliptical cross section as shown in FIG. 5 and complementarily shaped electrodes 11 and 12 with the outer surface of electrode 11 shaped to fit closely within the nozzle throat 42''. The length to width dimension ratio of the cross section is approximately 5:1, and throat length, L, as shown in FIG. 5 is approximately 4 inches. The preferred extinguishing fluids are mixtures of sulfur hexafluoride ($SF_6$) with other insulating gases.

While preferred features and the best mode of the invention have been shown, many modifications and changes will occur to those skilled in the art. For example, many shapes of nozzle throat and contacts other than rectangular and elliptical would provide the dimension relationship as described herein. It is, therefore, to be understood that the appended claims are intended to cover all such modifications and changes as fall within the true scope of the invention.

I claim:

1. In a fluid blast circuit breaker comprising: a switching chamber; first and second relative movable contacts located within said chamber, at least one of said contacts being movable along a predetermined path of travel between a first position in which said contacts are in contact and a second position in which said contacts are separated; said path of travel being along an axis of a nozzle means having a convergent-divergent central passage with a throat defining at least part of said path; said nozzle means located in said switching chamber fixedly disposed relative to one of said contacts such that the other of said contacts extends through said throat only when said contacts are in said first position and is situated axially outside said throat when said contacts are in said second position; means in flow communication with said throat for supplying arc-extinguishing fluid in a blast to said throat when said contacts are moved from said first position to cool any arc occurring between said contacts, the improvement comprising:

said central passage and said throat of said nozzle means and said contacts having a rectangular cross section transverse to the nozzle means axis, with a first dimension of said cross section having a length of approximately 1½ to approximately 8 times the length of a second dimension of said cross section perpendicular to said first dimension, and said nozzle and said one of said contacts being disposed such that a narrow rectangular gap is formed therebetween.

2. The circuit breaker of claim 1, wherein said first dimension is approximately 5 times said second dimension.

3. The circuit breaker of claim 1, wherein said other of said contacts fits closely within said throat, whereby said throat is closed by said other of said contacts to prevent flow of arc-extinguishing fluid into said throat, when said contacts are in said first position.

4. The circuit breaker of claim 1, wherein said means in flow communication with the throat for supplying arc-extinguishing fluid comprises a chamber having one movable wall for pressurizing and expelling said fluid to said throat.

5. The circuit breaker of claim 4, wherein said arc-extinguishing fluid is a gas.

6. The circuit breaker of claim 5, wherein said gas is sulfur hexafluoride.

7. The circuit breaker of claim 5 wherein said gas is a mixture of sulfur hexafluoride and a fluorocarbon gas.

8. The circuit breaker of claim 1, wherein said means in flow communication with the throat for supplying arc-extinguishing fluid comprises a chamber having an inlet for filling said chamber with a volume of said fluid under pressure.

9. The circuit breaker of claim 8, wherein said fluid is a gas.

10. The circuit breaker of claim 9, wherein said gas is sulfur hexafluoride.

11. The circuit breaker of claim 9, wherein said gas is a mixture of sulfur hexafluoride and a fluorocarbon gas.

12. In a fluid blast circuit breaker comprising: a switching chamber; first and second relatively movable contacts located within said chamber, at least one of said contacts being movable along a predetermined path of travel between a first position in which said contacts are in contact and a second position in which said contacts are separated; said path of travel being along an axis of a nozzle means having a convergent-divergent central passage with a throat defining at least part of said path; said nozzle means located in said switching chamber fixedly disposed relative to one of said contacts such that the other of said contacts extends through said throat only when said contacts are in said first position and is situated axially outside said throat when said contacts are in said second position; means in flow communication with said throat for supplying arc-extinguishing fluid in a blast to said throat when said contacts are moved from said first position to cool any arc occurring between said contacts, the improvement comprising:

said central passage and said throat of said nozzle means and said contacts having an elliptical cross section transverse to the nozzle means axis, with a first dimension of said cross section having a length of approximately 1½ to approximately 8 times the length of a second dimension of said cross section perpendicular to said first dimension, and said nozzle and said one of said contacts being disposed such that a narrow eliptical gap is formed therebetween.

13. The circuit breaker of claim 12, wherein said first dimension is approximately 5 times said second dimension.

14. The circuit breaker of claim 12, wherein said other of said contacts fits closely within said throat, whereby said throat is closed by said other of said contacts to prevent flow of arc-extinguishing fluid into said throat, when said contacts are in said first position.

15. The circuit breaker of claim 12, wherein said means in flow communication with the throat for supplying arc-extinguishing fluid comprises a chamber having one movable wall for pressurizing and expelling said fluid to said throat, and wherein said arc-extinguishing fluid is a gas.

16. The circuit breaker of claim 15, wherein said gas is sulfur hexafluoride.

17. The circuit breaker of claim 15 wherein said gas is a mixture of sulfur hexafluoride and a fluorocarbon gas.

18. The circuit breaker of claim 12, wherein said means in flow communication with the throat for supplying arc-extinguishing fluid comprises a chamber having an inlet for filling said chamber with a volume of said fluid under pressure, and wherein said fluid is a gas.

19. The circuit breaker of claim 18, wherein said gas is sulfur hexafluoride.

20. The circuit breaker of claim 18, wherein said gas is a mixture of sulfur hexafluoride and a fluorocarbon gas.

* * * * *